US005148408A

United States Patent [19]

Matthews

[11] Patent Number: 5,148,408

[45] Date of Patent: Sep. 15, 1992

[54] ACOUSTIC DATA TRANSMISSION METHOD

[75] Inventor: H. Gerard Matthews, Haddam, Conn.

[73] Assignee: Teleco Oilfield Services Inc., Meriden, Conn.

[21] Appl. No.: 609,471

[22] Filed: Nov. 5, 1990

[51] Int. Cl.[5] ..... G01V 1/40

[52] U.S. Cl. ..... 367/82

[58] Field of Search ..... 367/82; 340/853, 861

[56] References Cited

U.S. PATENT DOCUMENTS

| | | | |
|---|---|---|---|
| 3,889,228 | 6/1975 | Shawhan | 367/82 |
| 4,293,936 | 10/1981 | Cox et al. | 367/82 |
| 4,562,559 | 12/1985 | Sharp et al. | 367/82 |

OTHER PUBLICATIONS

Drumheller, D. S., "Acoustical Properties of Drill Strings," J. Acoust. Soc. Amer. 85(3), Mar. 1989.

*Primary Examiner*—Ian J. Lobo

*Attorney, Agent, or Firm*—Fishman, Dionne & Cantor

[57] ABSTRACT

A method of acoustically transmitting data signals is presented. In accordance with the present invention, the optimum transmission frequencies for transmitting and receiving acoustic data signals are determined by use of at least two spaced acoustic transmitter/receiver pairs located at or near opposed ends of the drillstring. Using the method of this invention, one acoustic transmitter will transmit at different frequencies while transmitted signal characteristics are monitored by the acoustic receiver at the other end of the drillstring. As a result, the optimum frequencies are determined for that particular drillstring geometry. This adaptive procedure allows the downhole acoustic transmitter to transmit uphole to the uphole acoustic receiver at the identified optimum frequencies. This adaptive method of optimizing transmission frequencies is continued as segments of drill pipe are added and other drillstring parameters change.

14 Claims, 2 Drawing Sheets

ACOUSTIC DATA TRANSMISSION METHOD

BACKGROUND OF THE INVENTION

This invention relates generally to a method for acoustically transmitting data along a drill string, and more particularly to a method of enhancing acoustic data transmissions by use of at least a pair of transmitter/receiver transducers positioned at or near opposed ends of the drillstring.

Deep wells of the type commonly used for petroleum or geothermal exploration are typically less than 30 cm (12 inches) in diameter and on the order of 2 km (1.5 miles) long. These wells are drilled using drill strings assembled from relatively light sections (either 30 or 45 feet long) of steel drill pipe that are connected end-to-end by tool joints, additional sections being added to the uphole end as the hole deepens. The downhole end of the drill string typically includes a drill collar, a dead weight section assembled from relatively heavy lengths of uniform diameter steel tubes ("drill collars") having an overall length on the order of 300 meters (1000 feet). A drill bit is attached to the downhole end of the lowermost drill collar, the weight of the collar causing the bit to bite into the earth as the drill string is rotated from the surface. Sometimes, downhole mud motors or turbines are used to turn the bit. Drilling mud or air is pumped from the surface to the drill bit through an axial hole in the drill string. This fluid removes the cuttings from the hole, can provide a hydrostatic head which controls the formation fluids, and provides cooling for the bit.

Communication between downhole sensors of parameters such as pressure or temperature and the surface has long been desirable. Various methods that have been used or attempted for this communication include electromagnetic radiation through the ground formation, electrical transmission through an insulated conductor, pressure pulse propagation through the drilling mud, and acoustic wave propagation through the metal drill string. Each of these methods has disadvantages associated with signal attenuation, ambient noise, high temperatures, and compatibility with standard drilling procedures. The most commercially successful of these methods has been the transmission of information by pressure pulse in the drilling mud (known as mud pulse telemetry). However, such systems are generally limited to a transmission rate on the order of about 1 data bit per second.

Faster data transmission may be obtained by the use of acoustic wave propagation through the drillstring. While this method of data transmission has heretofore been regarded as impractical, a significantly improved method and apparatus for the acoustic transmission of data through a drillstring is disclosed in U.S. Pat. application Ser. No. 605,255 filed Oct. 29, 1990, entitled "Acoustic Data Transmission Through a Drill String", which is a continuation-in-part of U.S. application Ser. No. 453,371 filed Dec. 22, 1989 (all of the contents of the CIP application being fully incorporated herein by reference), which will permit large scale commercial use of acoustic telemetry in the drilling of deep wells for petroleum and geothermal exploration.

U.S. Ser. No. 605,255 describes an acoustic transmission system which employs a downhole transmitter for converting an electrical input signal into acoustic energy within the drill collar. The transmitter includes a pair of spaced transducers which are driven by signal processing circuitry. This signal processing circuitry controls phasing of electrical signals to and from the transducers to produce an acoustical signal which travels in only one direction. A receiver is positioned on the drillstring at or near the surface for receiving data transmitted by the downhole transmitter.

The acoustic data transmission characteristics along a segmented tubular structure such as a drill pipe used for drilling a well are determined by physical properties such as the number and length of pipe segments, mass and wear condition of joints and the modulus of the material (typically steel). In acoustic data transmission, there exist both passband and stop-band frequency domains. As just mentioned, the frequencies of these bands are determined by the material and properties of the tubular structure as well as by the geometry of the segments. Data can be transmitted readily at the passband frequencies, but signals at the stop-band frequencies are rapidly attenuated by local internal reflections and thus lost. Also, within the passbands there is a fine structure of low loss passbands interspersed with bands where very high attenuation occurs. These fine structure bands are described in some detail in an article entitled "Acoustical Properties With Drillstrings" by Douglas S. Drumheller, J. Acoust. Soc. Am 85 (3), pp. 1048–1064, March, 1989. As described in the Drumheller paper, the fine structure bands are caused by the destructive interference of acoustic waves reflected from the ends of the tube with the original signal wave, when the two waves arrive at the receiver substantially out of phase. As a result of this fine structure phenomenon, the passband frequencies depend upon the overall length of the tube. This creates difficulties in transmitting data when the overall length of the tube is changing, as in drilling operations where the depth of the well, and hence the length of the tube (drill pipe) is constantly increasing thereby changing the fine structure bands. Because of the presence of this fine structure and the constantly changing nature of the fine structure, it is very difficult to identify the optimum transmission frequencies for accurately transmitting acoustic data signals.

SUMMARY OF THE INVENTION

The above-discussed and other problems and deficiencies of the prior art are overcome or alleviated by the method of acoustically transmitting data signals of the present invention. In accordance with the present invention, the optimum transmission frequencies for transmitting/receiving acoustic data signals are determined by use of at least two spaced acoustic transmitter/receiver pairs located at or near opposed ends of the drillstring. Using the method of this invention, the one acoustic transmitter will transmit at different frequencies while transmitted signal characteristics are monitored by the acoustic receiver at the other end of the drillstring. As a result, the optimum frequencies are determined for that particular drillstring geometry. This adaptive procedure allows the downhole acoustic transmitter to transmit uphole to the uphole acoustic receiver at the identified optimum frequencies. This adaptive method of optimizing transmission frequencies is continued as segments of drill pipe are added and other drillstring parameters change.

In another embodiment of the present invention, a plurality of transmitter/receiver pairs are positioned at intervals along the length of the drillstring. Since different segments of drill pipe may have different frequency characteristics, this alternative embodiment would permit each adjacent transmitter/receiver pair to communicate and determine optimum frequencies for acoustically communicating over the intervening drill pipe section.

The acoustic telemetry system of this invention may also employ transmission of multiple optimized frequencies simultaneously to improve communication quality.

The above discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
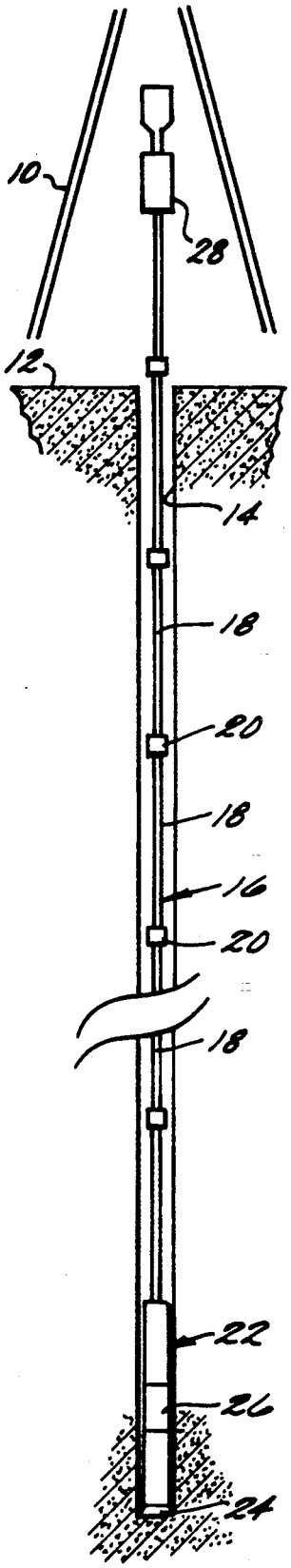
FIG. 1 is a cross-sectional elevation view depicting a downhole drilling apparatus and drillstring employing an acoustic signal transmission means in accordance with the present invention.

Referring first to FIG. 1, a schematic of a drillstring utilizing an acoustic telemetry system such as the type described in U.S. Ser. No. 605,255 is shown. In FIG. 1, a drilling rig 10 is positioned on the surface 12 above a borehole 14 which is traversed by a drillstring 16. Drillstring 16 is assembled from sections of drill pipe 18 that are connected end-to-end by tool joints 20. It will be appreciated that additional sections of drill pipe 18 are added to the uphole end of drillstring 16 as the hole deepens. The downhole end of the drillstring includes a drill collar 22 composed of drill collar pipe having a diameter which is relatively larger than the diameter of the drill pipe sections 18. Drill collar section 22 includes a bottom hole assembly which terminates at drill bit 24 and which may include several drill collar sections housing downhole sensors for sensing parameters such as pressure, position or temperature. In accordance with a first embodiment of the present invention, one of the drill collar sections includes an acoustic transmitter/receiver pair 26 which communicates with an acoustic transmitter/receiver 28 uphole of drillstring 16 by the transmission (and receipt) of acoustic signals through the drillstring. Acoustic transmitter/receiver 26 and 28 are preferably of the type disclosed in U.S. Ser. No. 605,255, which has been fully incorporated herein by reference.

Figure 2:
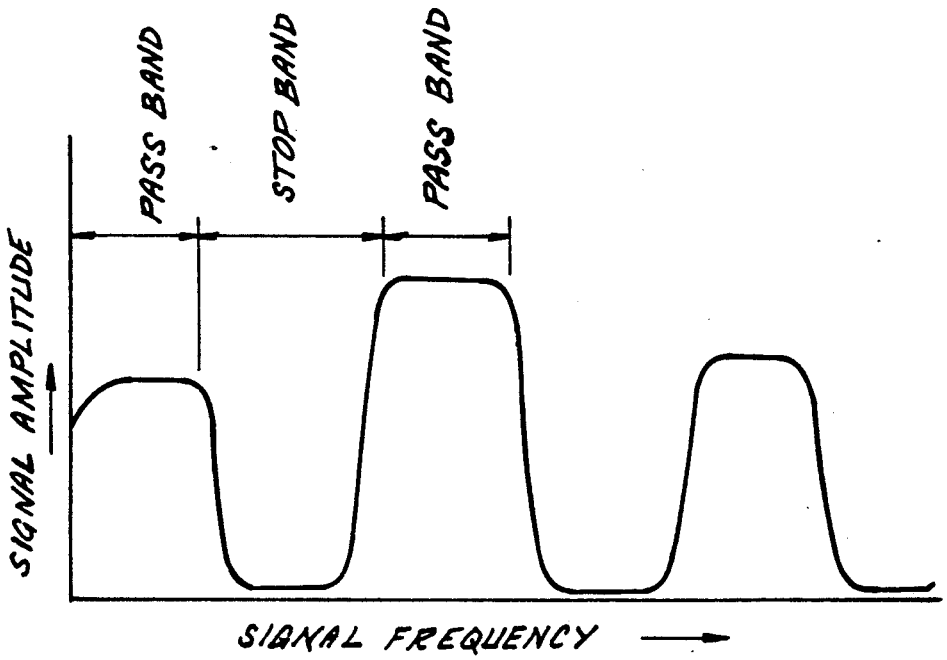
FIG. 2 is a graph of signal amplitude versus signal frequency in an acoustic transmission system depicting the several passbands and stop-bands for an initial characteristic of a received signal.
Figure 3:
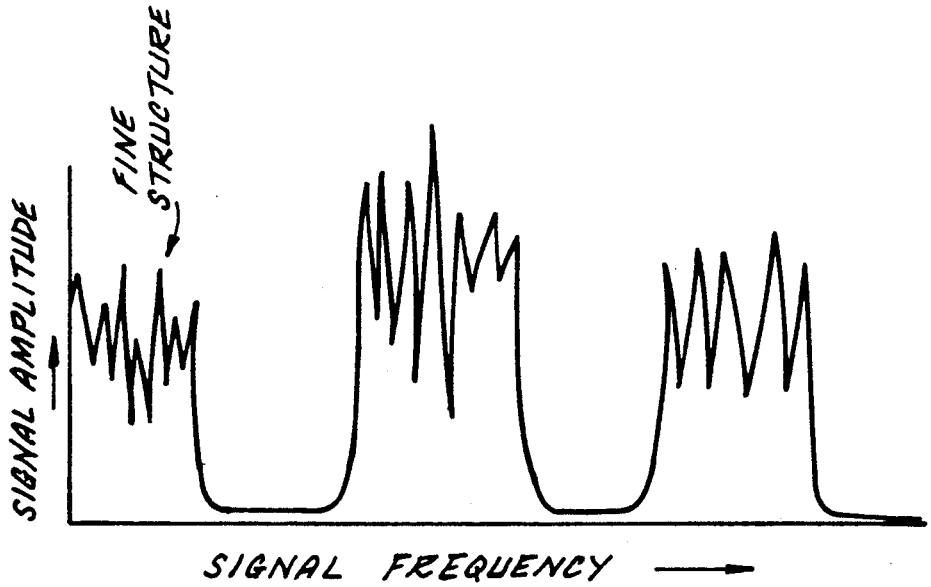
FIG. 3 is a graph similar to FIG. 2 depicting the stop-bands and pass bands of later characteristics of the received signals wherein the "fine structure" appears.

Acoustic transmitter 26 transmits acoustic signals which travel along drillstring 16 at the local velocity of sound, that is, about 16,000 feet per second if the waves are longitudinal and 10,000 feet per second if they are torsional. As shown in FIG. 2, the initial characteristic of a signal received by receiver 28 which has been transmitted by acoustic transmitter 26 has a plurality of alternating passbands and stop-bands with respect to signal frequency. It will be appreciated that frequencies chosen by acoustic transmitter 26 should be those with the lowest amount of attenuation within a passband. Unfortunately, the uniform low attenuation characteristic of the passbands of FIG. 2 do not persist with time. Instead, interfering signals resulting from reflections (ecohes) of the original transmitted signal create what is termed attenuation "fine structure" shown in FIG. 3. FIG. 3 depicts the attenuation characteristics of the received signal subsequent to interference by signal reflection; the "fine structure". In order to optimize transmission through such fine structure attenuation, transmission frequencies must be carefully selected. Of course, the frequency choice is thereby limited and difficult to achieve. Moreover, optimum frequency choice becomes even more difficult because the fine structure changes each time a new drill pipe 18 is added.

In accordance with the present invention, the optimum frequencies for communicating between the downhole acoustic transmitter 26 and the uphole receiver 28 are determined by an adaptive communication scheme wherein one transmitter/receiver pair (e.g. uphole pair 28) transmits different frequencies along drillstring 16 to the transmitter/receiver at the other end of the drillstring (e.g. downhole pair 26) while the receiver monitors the transmitted message. Upon receipt of a series of transmitted signals by the opposite end receiver, then the optimum frequencies may be determined for that particular drillstring geometry. At that point, the downhole transmitter/receiver pair 26 transmits data signals (based on information received by known measurement-while-drilling downhole sensors) using the optimum frequencies along drillstring 16 to the top transmitter/receiver pair 28. This method of using one transmitter/receiver pair to determine the optimum frequencies for transmitting downhole information is repeated throughout the drilling process as additional drill pipe sections 18 are added and as other parameters of drillstring 16 change. As a result, the present invention provides an adaptive method of continuously optimizing the transmission frequencies in the passbands (as shown in FIG. 2). Moreover, the present invention will be able to select the low attenuation transmission frequencies despite the presence of reflected signals which will cause the interference exhibited by the fine structure of FIG. 3. It will be appreciated that in this latter case, the optimum frequencies will be those frequencies which coincide with the tip of the "fingers" exhibited by the fine structure in a particular passband region.

It has been determined that the optimum frequencies for acoustic transmission along a drill pipe may change along the length of the drill pipe as a result of the differing pipe segments 18 in joints 20. In accordance with an alternative method of the present invention, rather than using only a single transmitter/receiver pair 26 at or near the bottom of drillstring 16, a plurality of transmitter/receiver pairs are located along the length of the drillstring at predetermined intervals with each adjacent transmitter receiver pair being in communication with another so that the optimized frequencies in a localized section of drillstring may be found. Each of these spaced transmitters/receivers pairs will be located at joints 20 along the length of the drillstring 16 selected by transmission criteria such as signal to noise ratio and data rate capacity.

As is clear from a review of FIGS. 2 and 3, acoustic transmission of data signals may be provided by a plurality of communications channels which result from the presence of the plurality of passbands. In still another embodiment, the present invention may take advantage of this phenomenon by employing the transmission of multiple optimized channels simultaneously. It will of course be appreciated that if several optimized data communications channels are thereby provided, the rate of data communication may be increased dramatically. The data transmitted in such optimized data channels may be encoded as FM, FSK, PSK or by any other appropriate technique given the optimized frequency characteristics of each channel.

As discussed above, optimizing signals sent between uphole and downhole acoustic transmitter/receiver pairs may be used for adaptive optimization of the actual data signals which transmit data from downhole sensors to the surface. Conversely, the adaptive optimization scheme of this invention may be used in a similar manner for transmission of control signals from the surface to downhole equipment. Such control signals could be used for a variety of applications including:

(1) control of data format from downhole;
(2) error correction;
(3) change or control of downhole tool operations (parameters); and
(4) change modulation or coding schemes of data signals.

Such control signals would be generated in a manner consistent with the method described above. Thus, optimum transmission frequencies between the uphole and downhole transmitter/receivers would be determined through an adaptive process; followed by the transmission of control signals at the optimum frequencies from the surface downhole to the electronics and sensors located near the drill bit.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A method for acoustically transmitting data through a drillstring having a plurality of drill pipe sections connected end-to-end by joints from a first location on the drillstring to a second location toward the opposite end of the drillstring, the length and cross-sectional area of the drill pipe sections being different from the length and cross-sectional area of the joints, at least one first acoustic transmitter/receiver pair being located at the first location and at least one second acoustic transmitter/receiver pair being located at the second location, the method comprising the steps of:

(1) generating from said first transmitter/receiver pair a plurality of first data free signals in at least one passband of the drillstring;
(2) transmitting said first data free signals through the drillstring from said first location to said second transmitter/receiver pair at said second location;
(3) detecting said first data free signals at said second transmitter/receiver pair, said detected first data free signals corresponding to optimum frequencies;
(4) generating from said second transmitter/receiver pair data signals having a frequency content corresponding to said optimum frequencies;
(5) transmitting said data signals through the drillstring from said second location to said first transmitter/receiver pair; and
(6) detecting the data signals at said first location.

2. The method of claim 1 wherein:

said first location corresponds to a location on the drillstring at or near the surface of the earth; and
said second location corresponds to a location on the drillstring at or near the bottom of the drillstring.

3. The method of claim 1 including the step of:

repeating steps (1)–(6) simultaneously over a preselected time period using first data free signals and data signals having different frequencies, said different frequencies occurring in different passbands.

4. The method of claim 1 including the step of:

positioning a plurality of transmitter/receiver pairs at spaced locations between said first and second locations; and
transmitting said first data free signals and said data signals between adjacent downhole transmitter/-receiver pairs.

5. The method of claim 1 including the step of:

repeating steps (1)–(6) when the characteristics of the drillstring change thereby updating said optimum frequencies.

6. The method of claim 5 including the step of:

repeating steps (1)–(6) when a section of drill pipe is added to the drillstring thereby updating said optimum frequencies.

7. A method for acoustically transmitting control signals through a drillstring having a plurality of drill pipe sections connected end-to-end by joints from a first location on the drillstring to a second location toward the opposite end of the drillstring, the length and cross-sectional area of the drill pipe sections being different from the length and cross-sectional area of the joints, at least one first acoustic transmitter/receiver pair being located at the first location and at least one second acoustic transmission/receiver pair being located at the second location, the method comprising the steps of:

(1) generating from said first transmitter/receiver pair a plurality of first data free signals in at least one passband of the drillstring;
(2) transmitting said first data free signals through the drillstring from said first location to said second transmitter/receiver pair at said second location;
(3) detecting said first data free signals at said second location transmitter/receiver pair, said detected first data free signal corresponding to optimum frequencies;
(4) generating from said second transmitter/receiver pair control signals having a frequency content corresponding to said optimum frequencies;
(5) transmitting said control signals through the drillstring from said second location to said first transmitter/receiver pair; and
(6) detecting the control signals at said first location.

8. The method of claim 1 wherein:

said first location corresponds to a location on the drillstring at or near the bottom of the drillstring; and
said second location corresponds to a location on the drillstring at or near the surface of the earth.

9. An apparatus for acoustically transmitting data through a drillstring having a plurality of drill pipe sections connected end-to-end by joints from a first location on the drillstring to a second location toward the opposite end of the drillstring, the length and cross-sectional area of the drill pipe sections being different from the length and cross-sectional area of the joints, at least one first acoustic transmitter/receiver pair being located at the first location and at least one second acoustic transmission/receiver pair being located at the second location, comprising:

means for generating from said first transmitter/-receiver pair a plurality of first data free signals in at least one passband of the drillstring;

means for transmitting said first data free signals through the drillstring from said first location to said second transmitter/receiver pair at said second location;

means for detecting said first data free signals at said second transmitter/receiver pair, said detected first data free signals corresponding to optimum frequencies;

means for generating from said second transmitter/-receiver pair data signals having a frequency content corresponding to said optimum frequencies;

means for transmitting said data signals through the drillstring from said second location to said first transmitter/receiver pair; and means for detecting the data signals at said first location.

10. The apparatus of claim 9 wherein:

said first location corresponds to a location on the drillstring at or near the surface of the earth; and said second location corresponds to a location on the drillstring at or near the bottom of the drillstring.

11. The apparatus of claim 9 including:

a plurality of transmitter/receiver pairs being positioned at spaced locations between said first and second, locations; and means for transmitting said first data free signals and said data signals between adjacent downhole transmitter/receiver pairs.

12. An apparatus for acoustically transmitting control signals through a drillstring having a plurality of drill pipe sections connected end-to-end by joints from a first location on the drillstring to a second location toward the opposite end of the drillstring, the length and cross-sectional area of the drill pipe sections being different from the length and cross-sectional area of the joints, at least one first acoustic transmitter/receiver pair being located at the first location and at least one second acoustic transmission/receiver pair being located at the second location, comprising:

means for generating from said first transmitter/-receiver pair a plurality of first data free signals in at least one passband of the drillstring;

means for transmitting said first data free signals through the drillstring from said first location to said second transmitter/receiver pair at said second location;

means for detecting said first data free signals at said second transmitter/receiver pair, said detected first data free signals corresponding to optimum frequencies;

means for, generating from said second transmitter/-receiver pair control signals signals having a frequency content corresponding to said optimum frequencies;

means for transmitting said control signals through the drillstring from said second location to said first transmitter/receiver pair; and means for detecting the control signals at said first location.

13. The apparatus of claim 12 wherein:

said first location corresponds to a location on the drillstring at or near the bottom of the drillstring; and said second location corresponds to a location on the drillstring at or near the surface of the earth.

14. The apparatus of claim 12 including:

a plurality of transmitter/receiver pairs being positioned at spaced locations between said first and second; locations; and means for transmitting said first data free signals and said data signals between adjacent downhole transmitter/receiver pairs.

* * * * *

UNITED STATES PATENT AND TRADEMARK OFFICE
CERTIFICATE OF CORRECTION

PATENT NO. : 5,148,408

DATED : September 15, 1992

INVENTORS : H. Gerard Matthews

It is certified that error appears in the above-identified patent and that said Letters Patent is hereby corrected as shown below:

Col. 4, line 4: Delete "ecohes" and insert therefor --echoes--.

Col. 4, line 57: Delete "transmitter receiver" and insert therefor --transmitter/receiver--.

Col. 7, line 30: Delete "second," and insert therefor --second--.

Col. 8, line 18: Delete "signals", second occurrence.

Col. 8, line 35: Delete "second;" and insert therefor --second--.

Signed and Sealed this

First Day of March, 1994

Bruce Lehman

*Attest:*

BRUCE LEHMAN

*Attesting Officer*

*Commissioner of Patents and Trademarks*